US006028517A

United States Patent [19]

Sansone et al.

[11] Patent Number: 6,028,517

[45] Date of Patent: Feb. 22, 2000

[54] STATUS INDICATING SYSTEM FOR INDICATING THE DEPOSIT AND WITHDRAWAL OF ITEMS IN A RECEPTACLE

[75] Inventors: Ronald P. Sansone, Weston; Richard A. Bernard, Norwalk; Fran E. Blackman, Weston; Denis J. Stemmle, Milford; Daniel F. Dlugos, Huntington; Edilberto I. Salazar, Brookfield; Karin A Russo, Redding; John N. D. Moody, Westport, all of Conn.

[73] Assignee: Pitney Bowes Inc., Stamford, Conn.

[21] Appl. No.: 09/220,011

[22] Filed: Dec. 23, 1998

[51] Int. Cl.[7] ..... G08B 21/00

[52] U.S. Cl. ..... 340/569; 232/34; 232/35; 232/36; 232/37; 340/522; 340/691.1; 340/691.4; 340/691.6

[58] Field of Search ..... 340/569, 691.6, 340/691.4, 691.1, 522; 232/34, 35, 36, 37

[56] References Cited

U.S. PATENT DOCUMENTS

| | | | |
|---|---|---|---|
| 4,314,102 | 2/1982 | Lowe et al. | 340/569 |
| 4,520,350 | 5/1985 | Huang | 340/569 |
| 4,651,135 | 3/1987 | Duhaime et al. | 340/569 |
| 4,794,377 | 12/1988 | Benages | 340/569 |
| 5,377,906 | 1/1995 | Mason | 232/34 |
| 5,440,294 | 8/1995 | Mercier et al. | 340/569 |
| 5,695,113 | 12/1997 | Rau et al. | 232/34 |
| 5,818,316 | 10/1998 | Varga et al. | 340/569 |

OTHER PUBLICATIONS

Japanese Patent Public Disclosure No. 9–231419, Application No. 8–37784, disclosed Sep. 5, 1997.

*Primary Examiner*—Glen Swann

*Attorney, Agent, or Firm*—Ronald Reichman; Michael E. Melton

[57] ABSTRACT

The status of deposits or withdrawals of items in a receptacle is indicated to one or more users having access to the receptacle. A receptacle is accessible by at least one user and is capable of containing an item. A deposit/withdrawal sensor for sensing a deposit or withdrawal of an item in the receptacle is also provided. A user identifier for identifying a user having access to the receptacle during the deposit or withdrawal of the item sensed by the deposit/withdrawal sensor is employed by the system. One or more indicators that are responsive to the deposit/withdrawal sensor and the user identifier are provided to indicate a deposit or withdrawal of the item in the receptacle by the identified user. The indicators may be placed on the receptacle or may be located remote from the receptacle.

20 Claims, 7 Drawing Sheets

| EVENT | USER 1 DEPOSIT MASS | USER 1 WITHDRAWAL MASS | USER 2 DEPOSIT MASS | USER 2 WITHDRAWAL MASS | INDICATION |
|---|---|---|---|---|---|
| 1 | A | | | | S1 |
| 2 | | | | A | S2 |
| 3 | | | B | | S3 |
| 4 | | B | | | S4 |
| 5 | | | C | | S3 |
| 6 | D | C | | | S1, S4 |
| 7 | | | | D | S2 |
| 8 | E | | | | S1 |
| 9 | | | F | E | S2, S3 |
| 10 | | F | | | S4 |

FIG.6

STATUS INDICATING SYSTEM FOR INDICATING THE DEPOSIT AND WITHDRAWAL OF ITEMS IN A RECEPTACLE

FIELD OF INVENTION

The present invention relates generally to systems for indicating the deposit and withdrawal of items in a receptacle, such as a mailbox. More particularly, the present invention relates to a system for indicating the status of deposits and withdrawals of items in a receptacle, such as a mailbox, to at least one user having access to the receptacle.

BACKGROUND OF THE INVENTION

There are numerous systems for indicating the presence of mail in a mailbox described in the prior art. For example, see U.S. Pat. No. 4,651,135 which discloses a mail detector for indicating the presence of mail in a mailbox to a postal customer. The mail detector is disposed in the mailbox and includes an indicator on the mailbox and a duplicate indicator in the postal customer's residence to indicate the presence of mail in the mailbox to the postal customer. U.S. Pat. No. 4,520,350 discloses a detector system which includes a wireless transmitter and wireless receiver. When mail is detected by the system, the transmitter sends a signal to the receiver triggering an indicator indicating the presence of mail to the postal customer.

In both of these patents, the described devices are intended to relieve the postal customer of the burdens of checking whether the mailbox contains mail. However, the above described systems do not provide mechanisms to relieve some burdens on the postal carrier. For example, in the event that a carrier has no mail to deliver to a particular postal customer having such a device, the carrier may still have to make a stop at the postal customer's mailbox to determine whether the customer has left mail for pickup by the carrier. In some situations, it may be desirable to indicate the presence of mail to the postal carrier and also the withdrawal of certain mail by the postal customer to the postal carrier or post office. Neither of these devices provide an indication for the postal carrier that the postal customer has deposited mail in the mailbox nor that the postal customer or postal carrier has withdrawn certain mail deposited in the box.

SUMMARY OF THE INVENTION

It is an object of the present invention to distinctly indicate the deposit and withdrawal of an item in a receptacle to two users of the receptacle.

The foregoing objectives are realized by the present invention which is a status indicator system for indicating the status of deposits or withdrawals of items in a receptacle to at least one user having access to the receptacle. The system comprises a receptacle which is accessible by one or more users and which is capable of containing an item. A deposit/withdrawal sensor for sensing a deposit or withdrawal of an item in the receptacle is also provided. A user identifier for identifying a user having access to the receptacle during the deposit or withdrawal of the item sensed by the deposit/withdrawal sensor is employed by the system. One or more indicators that are responsive to the deposit/withdrawal sensor and the user identifier are provided to indicate a deposit or withdrawal of the item in the receptacle by the identified user. The indicators may be placed on the receptacle or may be located remote from the receptacle.

Other objects and advantages of the present invention will become apparent to those skilled in the art from the following detailed description read in conjunction with the attached drawings and claims appended hereto.

BRIEF DESCRIPTION OF THE DRAWINGS

For a fuller understanding of the nature and objects of the invention, reference should be made to the following detailed description taken in conjunction with the accompanying drawings, in which:

FIG. 6 is a diagram illustrating the tracking of items deposited and withdrawn from the receptacle by the second embodiment of the present invention.

DETAILED DESCRIPTION OF THE PREFERRED EMBODIMENTS

The present invention is particularly useful for relieving some of the burdens associated with special postal receipt and delivery requirements. For example, when a U.S. postal customer desires to send a mail piece with certified mail status, the person must currently bring that mail piece to the Post Office. The postal customer cannot simply leave the mail piece in the postal customer's mailbox to obtain such service. Also, when a U.S. postal customer is the intended recipient of a mail piece which requires a signature from the customer prior to delivery, the customer is usually required to go to the Post Office to receive the mail piece, which is provided to the customer only after receipt of the signature by the Post Office. The present invention is intended to relieve such burdens when the postal customer and postal service provider agree that such specialized mail can be left in a receptacle to which both have access, and for which the receptacle can indicate, from time to time, to both users the deposit and withdrawal status of such mail pieces in the receptacle.

Figure 1A:
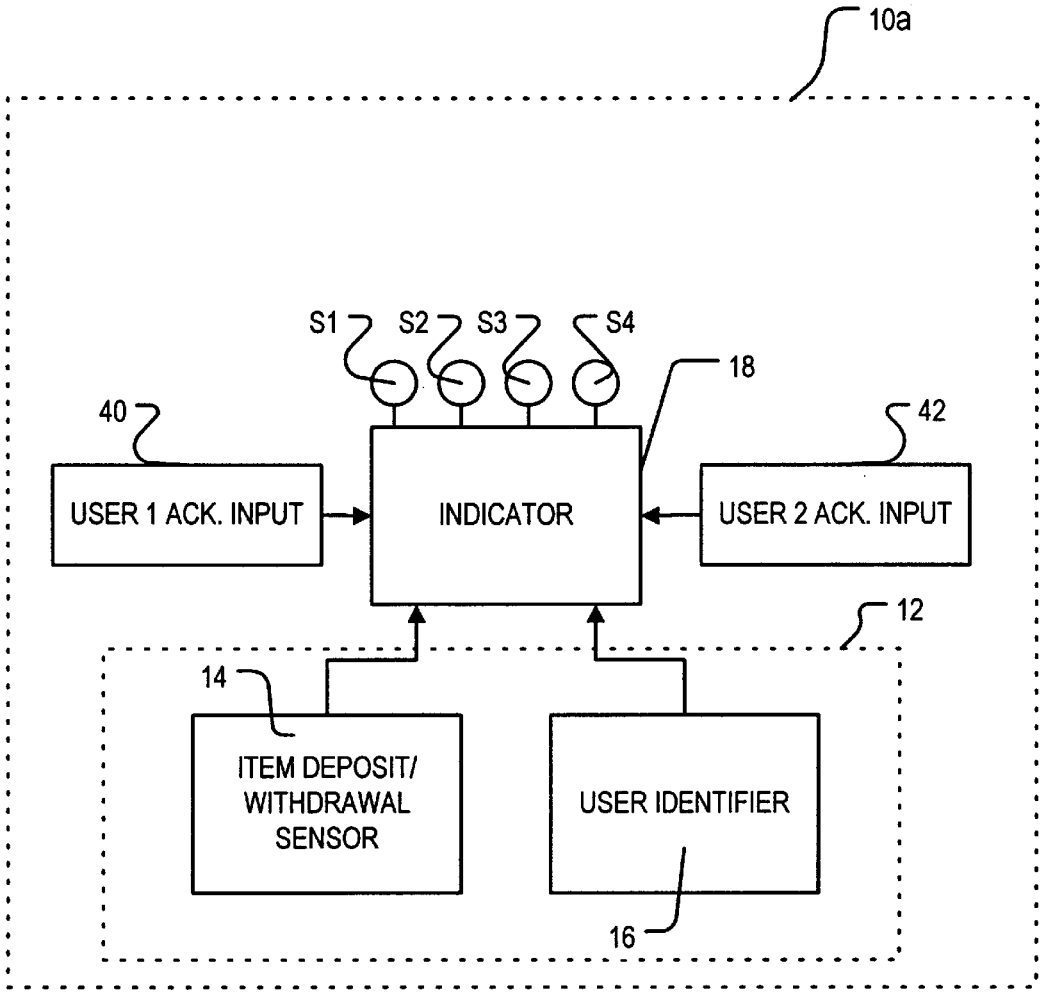
FIG. 1A is a general schematic diagram of a first embodiment of the apparatus of the present invention.

FIG. 1A illustrates a first embodiment of a basic indicator system 10*a* of the present invention. The basic indicator system 10*a* is capable of indicating the status of deposits or withdrawals of items in a receptacle 12, such as a mailbox, capable of containing one or more items, such as mail pieces, to two distinct users, such as a postal customer and a postal carrier or service provider, both having access to the receptacle 12. In the system 10*a*, the receptacle 12 is provided with a deposit/withdrawal sensor 14 which is capable of sensing the deposit or withdrawal of an item, such as a mail piece, in the receptacle 12. The system also includes a user identifier 16 for identifying the user having access to the receptacle 12 during the deposit or withdrawal of the item in the receptacle 12 as sensed by the deposit/withdrawal sensor 14. The system 10*a* is further provided with an indicator 18, which is responsive to the both the deposit/withdrawal sensor 14 and the user identifier 16, for indicating the status of a deposit or withdrawal from the receptacle 12 to the appropriate user.

Sensing the deposit or withdrawal of an item with the deposit/withdrawal sensor 14 can be accomplished by a device which can sense a change in mass or a change in volume occupied within the receptacle 12 caused by the deposit or withdrawal of the item in the receptacle 12. Thus, in the case where changes in mass are sensed, the deposit/withdrawal sensor 14 can be formed by an ordinary electronic scale or a device containing a piezoelectric material, both of which are capable of indicating a change of mass within the receptacle 12. In the case where changes in volume occupied are sensed, the deposit/withdrawal sensor 14 can be formed by an ultrasonic sensor capable of producing an ultrasonic signal in the receptacle, wherein the ultrasonic signal sent by the transducer is altered by the presence of an item in the receptacle, and such altered signal is received by the transducer. The sensor 14 could be one or more photoelectric devices, such as a photodiode receiving light from a light source. When an item is deposited, light from the light source is blocked from reaching the photodiode, thereby indicating an item in the receptacle. As will be explained further below, a mass sensor, such as a scale, is preferred because the tracking of the deposit and withdrawal of several items can be accomplished to provide appropriate indications to one or more users.

Figure 2A:
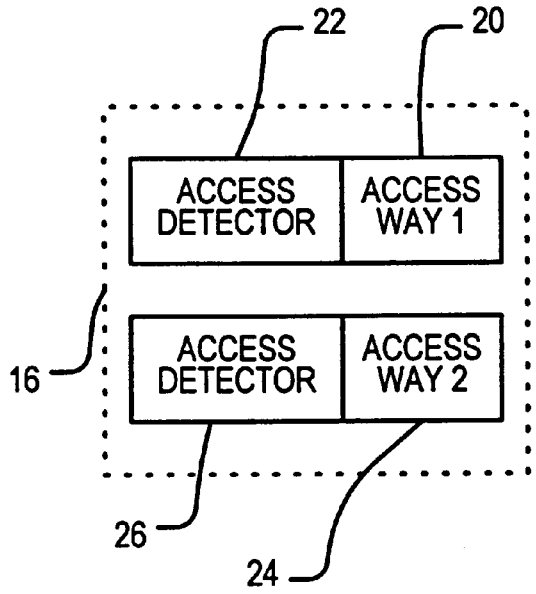
FIGS. 2A and 2B are schematic diagrams illustrating two versions of a first embodiment of the user identifier which may be employed by the present invention.

FIG. 2A illustrates a first embodiment of the user identifier 16 for identifying the user having access to the receptacle 12. In this embodiment, the user identifier 16 may be formed, in part, by providing a first accessway 20 in the receptacle 12 which is accessible only by one user and an access detector 22 cooperatively associated with the first accessway 20 to detect access to the receptacle 12 therethrough. In a two user identifying region, the receptacle is provided with a second accessway 24 which is accessible only by a second user and an access detector 26 cooperatively associated with the second accessway 22 to detect access to the receptacle 12 therethrough. Devices that may be used as access detectors include limit switches indicating the opening of a door, for example, or a light source and photo cell combination where a light beam projected onto the photo cell is interrupted when access to the receptacle 12 is made through the access way. Those skilled in the art will appreciate that the discussion of such devices is intended to merely be exemplary and not limiting.

Figure 2B:
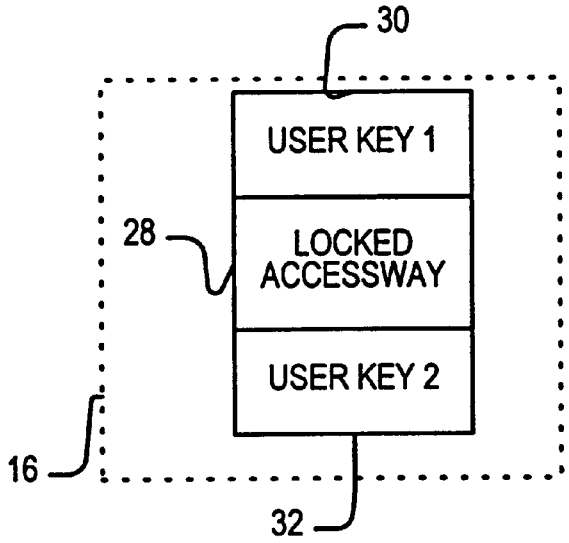

FIG. 2B illustrates a second embodiment of the user identifier 16. In a single user identifying version of this embodiment, the user identifier 16 may include a locked access way 28 in the receptacle 12 and a distinct user identifying key. In a two user identifying version (FIG. 2B) the accessway is common and the embodiment includes two or more distinct user identifying keys, such as a first key 30 which identifies the first user and enables the first user to gain access to the receptacle 12 via the locked common access way 28 and a second user key 32 which identifies the second user and enables the second user to gain access to the receptacle 12 via the locked common accessway 28. For example, the locked common access way may include an electronic door lock of the type typically found on hotel room doors, which accepts plastic key cards having magnetic strips encoded with information about the card and, presumably, the authorized user thereof. It will be obvious to one skilled in the art that the invention may be modified for three or more users.

Referring back to FIG. 1A, the indicator 18 may actuate distinct signaling devices S1, S2, S3 and S4, which may be as simple as a series of distinctly colored lights, light emitting diodes, distinct sounding buzzers, or a combination of both, located on the receptacle 12 or remotely therefrom. On the other hand, the signaling devices S1, S2, S3 and S4 may be as sophisticated as data entries in log files on a computer for logging each deposit and withdrawal event for the users of the system 10*a*. One or more of the signaling devices S1–S4 may be the ringer of a specific, predetermined telephone which is actuated at a specific time of day or the signaling device may comprise a message placed on a user's voice mail system or a message sent to a postal customer's household alarm system. Again, the above discussion is merely intended to provide examples, and is not intended to be limiting.

Figure 3:
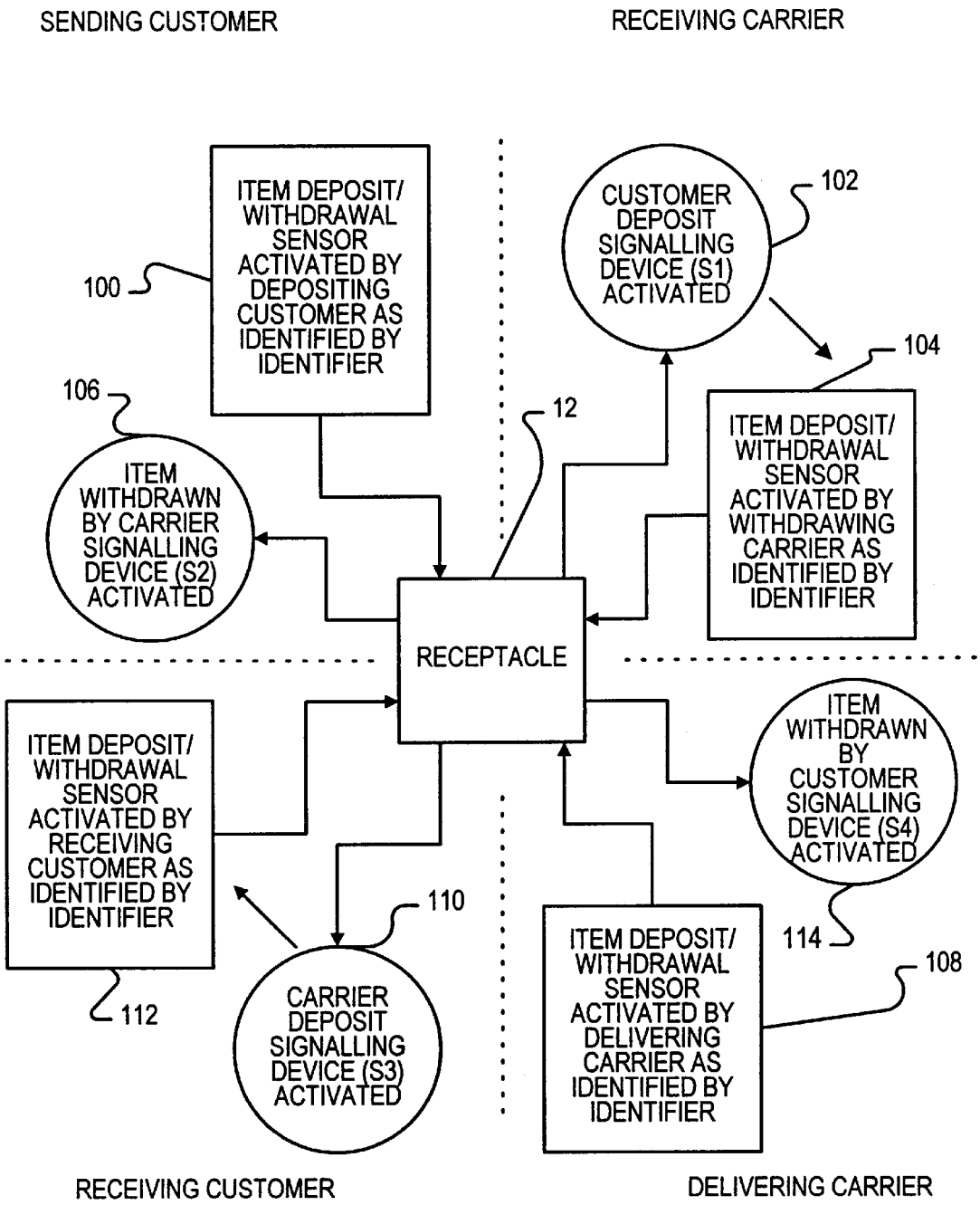
FIG. 3 is a schematic diagram illustrating the overall operation of either the first or second embodiment of the present invention in the context of the deposit and withdrawal of specialized mail by a postal customer and postal carrier.

Referring to FIG. 1A and the schematic diagram of FIG. 3, the overall operation of the present invention is illustrated in the context of the deposit and withdrawal of a mail piece by a postal customer and postal carrier, two users who have previously agreed to use the system 10*a*. Under such agreement, the indications given by the system 10*a* may also constitute equivalents for the required signatures and stampings provided by the postal customer and postal carrier, thereby eliminating the need for travel by the postal customer to the Post Office. Under the scenario illustrated, the indicator 18 activates at least four distinct signaling devices S1, S2, S3 and S4 which indicate the status of deposits and withdrawals to the two users. For example, the system 10*a* may be initiated by a deposit of an item in the receptacle 12 by a depositing/sending customer (step 100). The depositing customer is identified by the user identifier 16 and the deposit is sensed by deposit/withdrawal sensor 14. The deposit causes the indicator 18 to activate (step 102) signaling device S1 to indicate to the postal carrier that the customer associated with the receptacle 12 has made a deposit therein. Signaling device S1 may be located at the receptacle 12, at a remote location such as the Post Office, or both, for example. Signaling device S1 remains activated until the carrier withdraws (Step 104) the item from the receptacle. Thus, if a postal carrier has no mail to deliver to the receptacle for the postal customer, the postal carrier need not visit the receptacle unless signaling device S1 is activated. Accordingly, delivery route efficiencies may be improved.

Referring to FIGS. 1A and 3, the system may be set up so that the withdrawer, who is the postal carrier in this example, is identified by the user identifier 16 and the withdrawal (Step 104) is sensed by the deposit/withdrawal sensor 14. The withdrawal (Step 104) causes the indicator to activate signaling device S2 (Step 106) to indicate to the postal customer that the item has been withdrawn by the postal carrier (Step 104). Signaling device S2 may be located at the receptacle, located remote from the receptacle, or both. It should be realized by those skilled in the art that in both of the deposit and withdrawal events or transactions described above the postal carrier and postal customer need not examine the contents of the receptacle to know the status of the item in the receptacle 12. Thus, some of the burdens associated with examining the receptacle may be alleviated and increased efficiency obtained.

The system 10*a* may be provided with first user acknowledgement input device 40, or reset, which extinguishes signaling device S2. This device may be located at the receptacle 12 or remote therefrom.

As FIG. 3 illustrates, the system 10*a* may also be used to indicate deposit of an item in the receptacle 12 by the postal carrier, such as a specialized piece of mail, to the receiving customer as well as subsequent events relating to the piece of mail with respect to the receptacle 12. For example, the delivering postal carrier may deposit an item in the receptacle 12 (step 108). The delivering postal carrier is identified by the user identifier 16 and the deposit is sensed by deposit/withdrawal sensor 14. The deposit causes S3 to be activated (Step 110) by the indicator 18 to indicate to the receiving customer associated with receptacle 12 that the postal carrier has made a deposit therein. Signaling device S3 may be located at the receptacle 12, at a remote location such as the customer's home, or both, for example. Signaling device S3 remains activated until the receiving postal customer withdraws the item (Step 112) from the receptacle 12. The receiving postal customer withdrawer is identified by the user identifier 16 and the withdrawal is sensed by the deposit/withdrawal sensor 14. The withdrawal causes signaling device S4 to be activated (Step 114) by the indicator 18 to indicate to the carrier that the item has been withdrawn by the customer (Step 112). Signaling device S4 may be extinguished or deactivated by a second user acknowledgment input device 42, or reset, if desired. This input device may be located either at the receptacle or remotely.

Figure 1B:
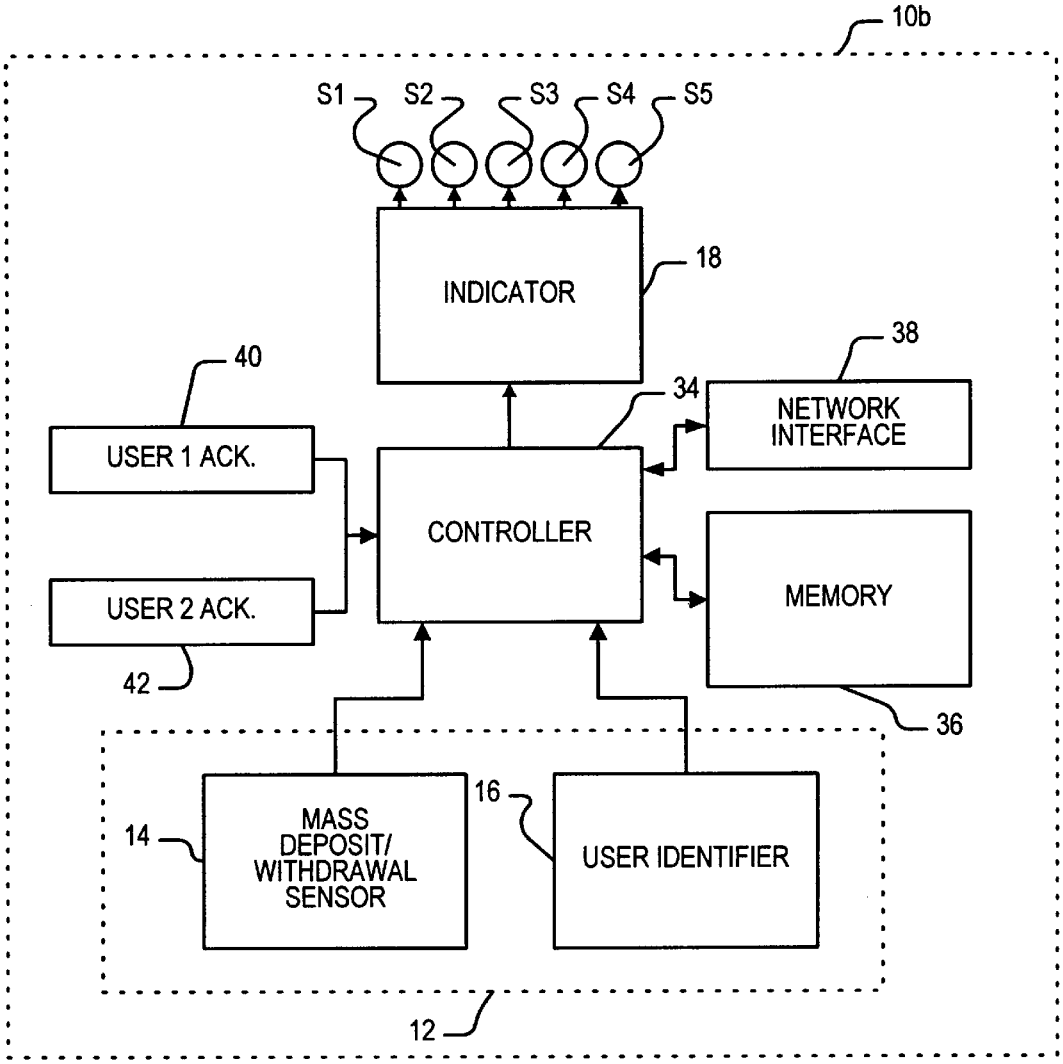
FIG. 1B is a general schematic diagram of a second embodiment of the apparatus of the present invention.

In FIG. 1B, a second embodiment 10*b* of the system is illustrated. In this embodiment, the system 10*b* is further provided with a controller 34 and memory device 36 communicating therewith. The controller 34 may be any microprocessor and the memory device 36 communicating therewith may be of a random access or magnetic storage media type. The controller 34 is disposed between the indicator 18 and the deposit/withdrawal sensor 14 and user identifier 16. The controller 34 may also include a network interface 38 for connection to a network 48 (FIG. 1C) for communicating status indications to a Post Office 50 or to the controller 34 of another status indicator system 10*b,* as will be explained below.

In the embodiment illustrated in FIG. 1B, the deposit/withdrawal sensor 14 is preferably of the mass sensing or mass change sensing type. Such a sensor enables a number of deposit and withdrawal events to be tracked and an events table for a receptacle may be developed and stored in the memory device 36 of the embodiment illustrated in FIG. 1B.

For example, referring to FIGS. 1B, 3 and 6, a postal customer (User 1) deposits (Step 100, FIG. 3) an item (mail) having mass A in the receptacle 12. The deposit of the item is sensed by sensor 14 and the postal customer is identified as the depositor 16. The status indicator 18 activates (Step 102) signaling device S1 to indicate the deposit by the customer. When S1 is activated, a record of this deposit may be created in the memory device 36 by the controller 34 and labeled as Event 1 (FIG. 6), for example. Although not shown in FIG. 6, any other information, such as time and date information, may be stored in the record labeled Event 1 in the memory device 36, if desired.

Subsequent to the Event 1, the postal carrier (User 2) withdraws (Step 104, FIG. 3) the item having mass A from the receptacle 12. The deposit/withdrawal sensor 14 senses a decrease of mass in the receptacle in the amount of mass A and the user identifier 16 identifies that the postal carrier (User 2) had access to the receptacle 12 at the time the mass decreased, thereby identifying the postal carrier as the withdrawer of the item having mass A. The status indicator 18 activates (Step 106, FIG. 3) signaling device S2 and extinguishes signaling device S1. When S2 is activated, a record of this withdrawal may be created in memory device 36 by the controller 34 and labeled as Event 2 (FIG. 6.)

Subsequent to Event 2, the postal carrier (User 2) deposits (Step 108, FIG. 3) an item having mass B in the receptacle 12. The deposit/withdrawal sensor 14 senses an increase of mass in the receptacle 12 in the amount of mass B and the user identifier 16 identifies that the postal carrier (User 2) had access to the receptacle 12 at the time the mass increased, thereby identifying the postal carrier as the depositor of the item having mass B. The status indicator 18 activates (Step 110, FIG. 3) signaling device S3. When S3 is activated, a record of this deposit may be created in memory device 36 by the controller 34 and labeled as Event 3 (FIG. 6.)

Thus, in examining the table or record of events (FIG. 6) stored in the memory device 36, it can be seen that in Event 4 a record was made that the postal customer (User 1) withdrew the item having mass B, which activated signaling device S4. In Event 5, the postal carrier (User 2) deposited an item having mass C which caused the indicator to activate signaling device S3, indicating to the postal customer (User 1) that an item was deposited in the receptacle 12. In Event 6, the postal customer (User 1) withdrew the item having mass C and also deposited an item having mass D. This event would have caused the indicator 18 to actuate signaling devices S1 and S4. In Event 7, the postal customer (User 1) withdrew the item having mass D from the receptacle 12, thereby causing the indicator 18 to actuate distinct signaling device S2. In Event 8, the postal customer (User 1) deposited an item having mass E in the receptacle 12, causing the indicator 18 to actuate signaling device S1. In Event 9, the postal customer (User 2) withdrew the item having mass E and deposited an item having mass F. This event caused signaling devices S2 and S3 to be actuated. In Event 10, the postal customer (User 1) withdrew the item having mass F, causing the signaling device S4 to be actuated.

If the deposit/withdrawal status indicating system of the embodiment illustrated in FIG. 1B is connected to a network 48 (FIG. 1C) via the network interface 38 and the Post Office has an event or transaction monitoring system 50 which is also connected to such network 48 and is capable of reading data from the memory device 36, then the Post Office may download the data from the memory device 36 of the system from time to time for a variety of purposes, including billing, audits or delivery or receipt confirmations, for example. Alternatively, the Post Office monitoring system 50 may store the events or transactions log as illustrated in FIG. 6 for each receptacle 12 having an indicator system 10*b* connected to the network 48, if desired.

Figure 1C:
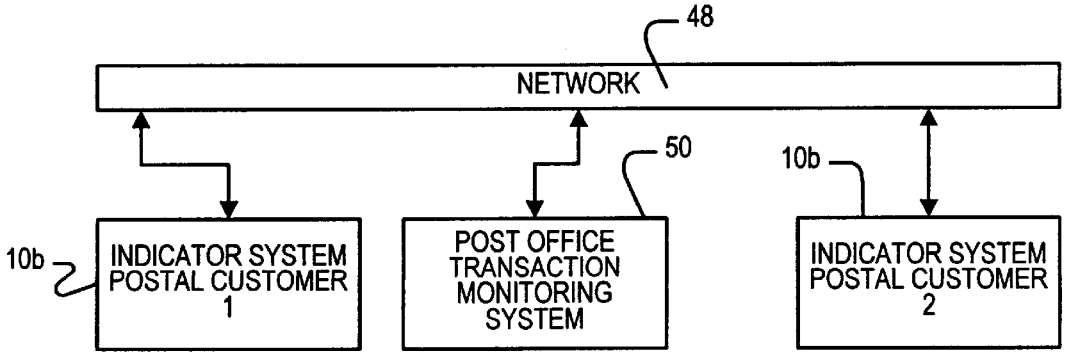
FIG. 1C is a general schematic diagram of two status indicating systems of the type illustrated in FIG. 1B connected to a network accessible by the Post Office.
Figure 4:
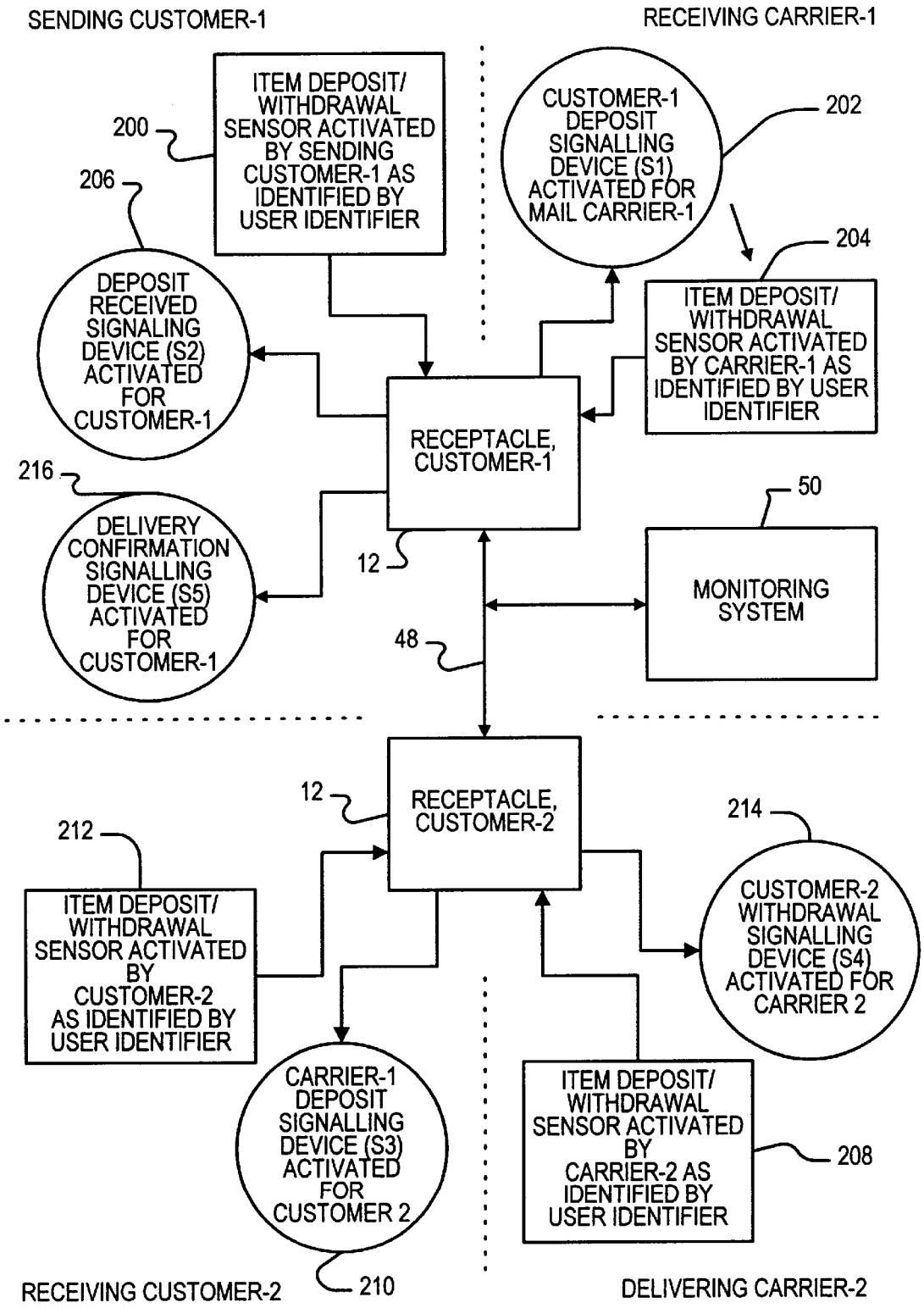
FIGS. 4 and 5 are schematic diagrams illustrating the overall operation of the second embodiment of the present invention in the context of a deposit and withdrawal of a specialized mail piece by a first postal customer and postal carrier and the deposit and withdrawal of the specialized mail piece by the postal carrier and a second postal customer.
Figure 5:
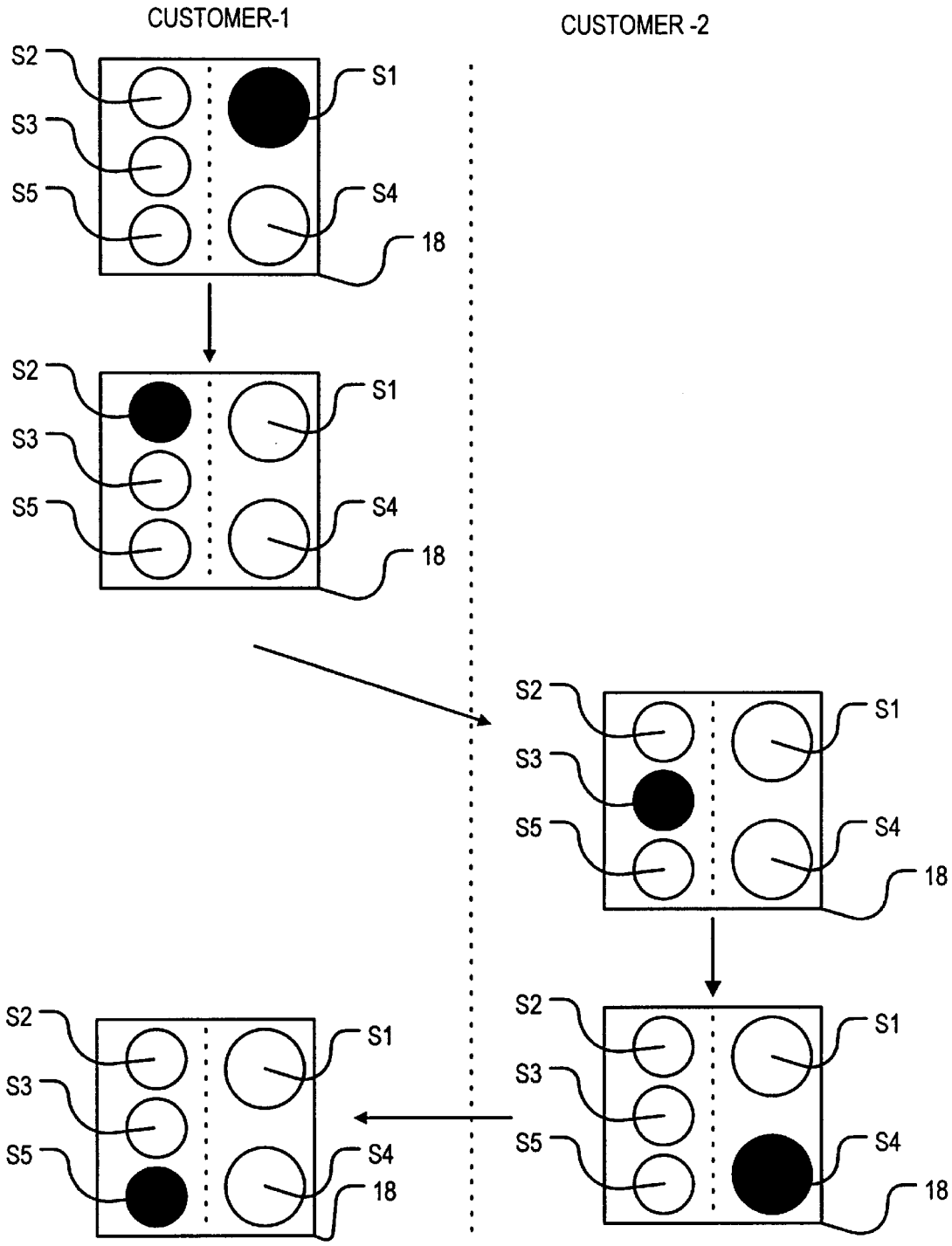

If two status indicating systems of the type illustrated in FIG. 1B are connected to the network 48 as illustrated in FIG. 1C, then it is possible that delivery receipts can be generated between two different postal customers. For example, referring to FIGS. 4 and 5, an item deposited in a first receptacle 12*a* by a first customer (Customer-1) intended for receipt by a second customer (Customer-2) causes the system 10*b* associated with Customer-1's receptacle 12*a* to activate its signaling device S1 (Step 202). Withdrawal by the receiving Carrier-1 (Step 204) causes the same system 10*b* to activate its associated signaling device S2 (Step 206) to confirm withdrawal to Customer-1. When the postal carrier, such as Carrier-2, for example, deposits the item in Customer-2's receptacle 12*b* (Step 208), the system 10*b* associated with that receptacle 12*b* causes its signaling device S3 to be activated (Step 210) to indicate the deposit to Customer-2. When Customer-2 withdraws the deposit (Step 212), the system 10*b* associated with that customer's receptacle 12*b* causes signaling device S4 to be activated (Step 214) to indicate withdrawal to Carrier-2. At nearly the same time, through the network 48 connected between the two receptacles 12*a,* 12*b,* signaling device S5 associated with the system 10*b* of Customer-1's receptacle 12*a* is also activated (Step 216) to confirm receipt by Customer-2 to Customer-1.

In the above described scenario, the system 10*b* could also be provided with a device for enabling a requesting customer, such as Customer-1, the provision of receipt confirmation instructions to the carrier. This enabling device may be as simple as a status indicator (not shown) indicating that the requester desires informal receipt confirmation or a formal return receipt.

Although the present invention has been described with respect to one or more particular embodiments of the device, it will be understood that other embodiments of the present invention may be made without departing from the spirit and scope of the present invention. Hence, the present invention is deemed limited only by the appended claims and the reasonable interpretation thereof.

What is claimed is:

1. A status indicator system for indicating the status of deposits to or withdrawals from a receptacle to one or more users having access to the receptacle, the system comprising:

a receptacle accessible by at least one user and capable of containing an item;

sensing means for sensing a deposit or withdrawal of an item in the receptacle;

identifying means for identifying a user having access to the receptacle during the deposit or withdrawal of the item sensed by the sensing means; and indicating means, responsive to the sensing means and the identifying means, for indicating a deposit or withdrawal of the item in the receptacle by the identified user.

2. The status indicating system of claim 1, wherein the identifying means for identifying a user having access to the receptacle is a first accessway in the receptacle accessible only by a first user, a first access detector cooperatively associated with the first accessway to detect access to the receptacle therethrough, a second accessway in the receptacle accessible only by a second user and a second access detector cooperatively associated with the second accessway to detect access to the receptacle therethrough.

3. The status indicating system of claim 1, wherein the identifying means for identifying a user having access to the receptacle includes a lockable common accessway, a first user key identifying a first user and enabling access to the receptacle via the common accessway to a first user and a second user key identifying a second user and enabling access to the receptacle via the common accessway to the second user.

4. The system of claim 1, wherein the sensing means is a mass sensor capable of sensing a change in mass within the receptacle caused by the deposit or withdrawal of the item in the receptacle.

5. The system of claim 4, wherein the mass sensor is a scale.

6. The system of claim 4, wherein the mass sensor is a piezoelectric device.

7. The system of claim 1, wherein the sensing means is a volume sensor capable of sensing a change in volume occupied within the receptacle caused by the deposit or withdrawal of the item in the receptacle.

8. The system of claim 7, wherein the volume sensor is an ultrasonic transducer capable of sending and receiving an ultrasonic signal in the receptacle, wherein the ultrasonic signal sent by the transducer is altered by the presence of an item in the receptacle, and such altered signal is received by the transducer.

9. The system of claim 1, wherein the sensing means is an optical sensor capable of detecting the item in the receptacle.

10. The system of claim 1, wherein the system further includes means for recording deposits and withdrawals of items in the receptacle.

11. A system for indicating the deposit and subsequent withdrawal of an item in a first receptacle to a first and second user having access to the first receptacle and for indicating a third user's withdrawal of the item subsequently deposited in a second receptacle to the first user, the system comprising:

a first receptacle accessible by the first and second users and capable of containing an item;

first sensing means for sensing a deposit or withdrawal of an item in the first receptacle;

first identifying means for identifying the user having access to the first receptacle during the deposit or withdrawal of the item sensed by the sensing means;

first indicating means, responsive to the first sensing means and the first identifying means, for indicating a deposit or withdrawal of the item in the first receptacle by the identified user;

a second receptacle accessible by a third user capable of containing the item;

second sensing means for sensing the withdrawal of an item from the second receptacle;

second identifying means for identifying the user having access to the second receptacle during withdrawal of the item sensed by the sensing means;

second indicating means, responsive to the second sensing means and the second identifying means, for indicating a withdrawal of the item in the second receptacle to the first user when the third user is identified during the sensed withdrawal.

12. The status indicating system of claim 11, wherein the means for identifying the user having access to the first receptacle is a first accessway in the first receptacle accessible only by the first user and a second accessway in the first receptacle accessible only by the second user.

13. The status indicating system of claim 11, wherein the means for identifying the user having access to the first receptacle is a first user key enabling access to the first receptacle by the first user and a second user key enabling access to the first receptacle by the second user.

14. The system of claim 11, wherein the first sensing means is a mass sensor capable of sensing a change in mass within the first receptacle caused by the deposit or withdrawal of the item in the receptacle.

15. The system of claim 14 wherein the mass sensor is a scale.

16. The system of claim 14, wherein the mass sensor is a piezo electric device.

17. The system of claim 11, wherein the first sensing means is a volume sensor capable of sensing a change in volume occupied within the first receptacle caused by the deposit or withdrawal of the item in the first receptacle.

18. The system of claim 17, wherein the volume sensor is an ultrasonic transducer capable of sending and receiving an ultrasonic signal in the receptacle, wherein the ultrasonic signal sent by the transducer is altered by the presence of an item in the receptacle, and such altered signal is received by the transducer.

19. The system of claim 11, wherein the second sensing means is a mass sensor capable of sensing a change in mass within the second receptacle caused by the withdrawal of the item in the second receptacle.

20. The system of claim 11, wherein the means for identifying the user having access to the second receptacle is an accessway in the second receptacle accessible only by the third user.

* * * * *